US011037406B2

(12) United States Patent
Harris et al.

(10) Patent No.: US 11,037,406 B2
(45) Date of Patent: Jun. 15, 2021

(54) GAMING SYSTEMS, GAMING MACHINES AND GAMES WITH INDEPENDENT FREE GAME AWARD FEATURE

(71) Applicant: Aries Technology, LLC, Las Vegas, NV (US)

(72) Inventors: Ronnie W. Harris, Las Vegas, NV (US); Janae Hoover, Las Vegas, NV (US); Rochelle Terman, Las Vegas, NV (US)

(73) Assignee: Aries Technology, LLC, Las Vegas, NV (US)

( * ) Notice: Subject to any disclaimer, the term of this patent is extended or adjusted under 35 U.S.C. 154(b) by 0 days.

(21) Appl. No.: 16/588,229

(22) Filed: Sep. 30, 2019

(65) Prior Publication Data

US 2021/0097813 A1 Apr. 1, 2021

(51) Int. Cl.

| | |
|---|---|
| ***G07F 17/00*** | (2006.01) |
| ***G07F 17/32*** | (2006.01) |
| *G07F 17/34* | (2006.01) |

(52) U.S. Cl.

CPC ..... *G07F 17/3267* (2013.01); *G07F 17/3209* (2013.01); *G07F 17/329* (2013.01); *G07F 17/3211* (2013.01); *G07F 17/3239* (2013.01); *G07F 17/3244* (2013.01); *G07F 17/34* (2013.01)

(58) Field of Classification Search

None

See application file for complete search history.

(56) References Cited

U.S. PATENT DOCUMENTS

| | | | | |
|---|---|---|---|---|
| 6,003,013 | A | 12/1999 | Boushy et al. | |
| 6,183,362 | B1 | 2/2001 | Boushy | |
| 6,656,434 | B1 | 12/2003 | DeMarcki | |
| 7,410,422 | B2 | 8/2008 | Fine | |
| 7,481,707 | B1 * | 1/2009 | Luciano, Jr. | G07F 17/3258 463/19 |
| 7,766,744 | B2 | 8/2010 | de Waal et al. | |
| 8,602,864 | B1 * | 12/2013 | Lewis | G07F 17/3244 463/18 |
| 10,242,531 | B2 * | 3/2019 | Colvin | G07F 17/329 |
| 2003/0144050 | A1 * | 7/2003 | Keaton | A63F 3/062 463/19 |
| 2005/0153768 | A1 | 7/2005 | Paulsen | |
| 2006/0121977 | A1 * | 6/2006 | Odom | A63F 3/0645 463/19 |

(Continued)

*Primary Examiner* — Paul A D'Agostino

(74) *Attorney, Agent, or Firm* — Weide & Miller, Ltd.

(57) ABSTRACT

Games, gaming machines and gaming systems are provided wherein a player playing a first wagering game may be awarded one or more free game plays (e.g. without the player having to place an additional wager) of a second wagering game which comprises a different game instance than the game that the player is playing. The one or more free games may be awarded based upon events or criteria occurring in the game that the player is playing or based upon events or criteria external thereto, or combinations thereof. The free games may comprise different game instances of the same game that the player is playing, or may comprise plays of different games, such as of games that the player may or may not select to play. The free games may be presented immediately or at a later time.

18 Claims, 6 Drawing Sheets

(56) References Cited

U.S. PATENT DOCUMENTS

| | | | | |
|---|---|---|---|---|
| 2007/0117608 | A1* | 5/2007 | Roper | G07F 17/3202 463/16 |
| 2007/0135205 | A1* | 6/2007 | Houle | G07F 17/32 463/19 |
| 2009/0011814 | A1* | 1/2009 | Lozano | G07F 17/329 463/19 |
| 2010/0120503 | A1* | 5/2010 | Hoffman | G07F 17/3209 463/20 |
| 2014/0057702 | A1* | 2/2014 | Lowell | G07F 17/3244 463/25 |
| 2014/0080567 | A1* | 3/2014 | Khal | A63F 3/0645 463/19 |
| 2014/0179393 | A1* | 6/2014 | Cuddy | G07F 17/3225 463/19 |
| 2015/0221168 | A1* | 8/2015 | Spark-Stahl | G07F 17/3267 463/25 |
| 2015/0287286 | A1* | 10/2015 | Beria | G07F 17/3213 463/20 |
| 2017/0046918 | A1* | 2/2017 | Colvin | G07F 17/329 |
| 2018/0139285 | A1 | 5/2018 | Hassan | |
| 2019/0180555 | A1* | 6/2019 | Elias | G07F 17/3211 |
| 2020/0242892 | A1* | 7/2020 | Luciano | G07F 17/329 |

* cited by examiner

| B | I | N | G | O |
|---|---|---|---|---|
| 11 | 20 | 61 | 1 | 63 |
| 23 | 6 | 53 | 21 | 8 |
| 40 | 32 | Free | 34 | 62 |
| 54 | 51 | 24 | 48 | 7 |
| 60 | 62 | 4 | 59 | 18 |

FIG. 5

GAMING SYSTEMS, GAMING MACHINES AND GAMES WITH INDEPENDENT FREE GAME AWARD FEATURE

FIELD OF THE INVENTION

The present invention relates to methods of presenting and playing games and gaming machines and systems which are configured to present games.

BACKGROUND OF THE INVENTION

A variety of wagering games exist today, including table wagering games such as card games, dice games, and roulette, and machine-based games such as slot and video poker games. In general, in exchange for placing a wager, a player is offered the opportunity to play these games for the chance to win an award (and lose their wager if the outcome of the game is losing as to the player).

Game developers are constantly seeking new ways to make their games exciting to players. One way developers have tried to make wagering games exciting is to add a bonus event. In case of machine-based games, these games generally have a base game portion which offers the player a chance for winnings. The game may also include the presentation of a bonus game portion. Generally, certain base game events trigger the presentation of the bonus game portion to the player, wherein the bonus game portion appears to have a winning or losing outcome (wherein winning outcomes result in additional winnings being awarded to the player).

In another configuration, a wagering game may trigger one or more free plays of the same game. For example, a player might place a wager to play a slot game in which reels are spun and stop to display a set of game symbols which define a winning or losing outcome. Certain outcomes may trigger additional spins of the reels for the player without the requirement for an additional wager.

In both of these instances, the additional aspects of game play are part of the same game math and pay tables for the game. The following examples show a very simplified configuration of a game design. In this example, Game 1 is a simple slot-type game which has four potential outcomes, each with a 25% chance of occurrence. The average payback for the game is thus 90%, or $0.90 for each $1.00 wagered.

Game 1

| Results | Odds | Outcome | Average Payout |
|---|---|---|---|
| 1 | .25 | Win 200 | .25 * 200 = .50 |
| 2 | .25 | Win 160 | .25 * 160 = .40 |
| 3 | .25 | Lose | .25 * 0 = .0 |
| 4 | .25 | Lose | .25 * 0 = .0 |
| | | | $0.90 total average payout |

In the following example, Game 1 is simply modified to include a respin feature, wherein one of the base slot game outcomes results in a respin. As can be seen, because the respin feature may result in an award of winnings to the player, the addition of the respin feature causes the average payout for the game to be 112.5%—e.g. the game would award, on average, $1.125 for each $1.00 wagered. As a result, this game would not be viable to the operator.

Game 2

| Results | Odds | Outcome | Average Payout |
|---|---|---|---|
| 1 | .25 | Win 200 | .25 * 200 = .50 |
| 2 | .25 | Win 160 | .25 * 160 = .40 |
| 3 | .25 | Lose | .25 * 0 = .0 |
| 4 | .25 | Respin | .25 * .9 = .225 |
| | | | $1.125 total average payout |

Thus, in order to accommodate the addition of the "in-game" respin feature, the game mechanic or the pay table must be changed. For example, only by lowering the payouts for winning outcomes in the game can the respin feature can be added and still generate a total average payout which is similar to Game 1, and which thus results in a "house hold."

Game 3

| Results | Odds | Outcome | Average Payout |
|---|---|---|---|
| 1 | .25 | Win 180 | .25 * 180 = .45 |
| 2 | .25 | Win 120 | .25 * 120 = .30 |
| 3 | .25 | Lose | .25 * 0 = .0 |
| 4 | .25 | Respin | .25 * .7 = .1875 |
| | | | $0.9375 total average payout |

Of course, to accommodate other features, such as bonus events which might result in the award of winnings, etc., the base game mechanic and/or pay table must be modified so that those features included.

This configuration has many limitations, including the fact that the "free" play events (respins, bonus events, etc.) which are awarded in the game are limited to those events which are programmed into the game mechanic and the math of the game, and wherein awards for those outcomes are all funded by the single wager the player placed to play the game. As one example, in order to stimulate play, a casino might wish to award free games to players of the game on Friday night, but not other nights. This is not possible given that the free game play is statically programmed into the game mechanic and the math of the game. Further, as noted above, these events can't simply be directly incorporated into these games without modifying them given that the addition of the events then changes the probabilities and payouts of the game.

A need still exists for games or features which create excitement for the player and which overcome drawbacks and limitations of the prior art.

SUMMARY OF THE INVENTION

Embodiments of the invention comprise games, gaming machines and gaming systems where a player playing a first wagering game may be awarded one or more free game plays (e.g. plays of a wagering game without the requirement that the player place an additional wager) of a second wagering game.

In one or more embodiments, the second free game is a completely separate or different game instance than the first game that the player is playing, wherein an outcome of the free game is thus also determined independently from the outcome of the game that the player is playing (e.g. the free game is not part of the game math or paytable of the game that the player is currently playing).

In one or more embodiments, the one or more free games may be awarded based upon events or criteria occurring in the game that the player is playing or based upon events or criteria external thereto, or a combination thereof.

In one or more embodiments, the free games may comprise separate plays or separate game instances of the same game that the player is playing, or may comprise free plays of a different game. As one example, a player who places a wager and plays game A may be awarded a free play of another instance of game A or a free play of an entirely different game, such as game B. As another example, a player may be presented with a menu of selectable games at a gaming machine, such as games A, B, C, etc. The player may select a game A to play and, relative to the play of game A, may be awarded one or more free games comprising free game plays of games B or C or the like, or might be awarded a free play of a game D which is not even selectable by the player.

The one or more free games may be presented immediately, including within the existing game or separately, or be presented or played at a later time.

Further objects, features, and advantages of the present invention over the prior art will become apparent from the detailed description of the drawings which follows, when considered with the attached figures.

DESCRIPTION OF THE DRAWINGS

FIG. 5 illustrates a bingo card in accordance with embodiments of the invention;

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Embodiments of the invention comprise games, gaming machines and gaming systems where a player playing a first wagering game may be awarded one or more free game plays of a second wagering game (e.g. a game which is not part of the game mechanic and math of the game that the player is currently playing and which has an outcome which is separately determined). The one or more free games play be playable at the same gaming machine or may only be playable at a different gaming machine.

In one embodiment, the free games may be separate instances of the same game that the player is playing, or might comprise the play of an entirely different game.

As one example, a gaming machine may be configured to present a plurality of different games, where each of the games is individually selectable by a player for play. During play of any of the games, one or more free games may be awarded. In one embodiment, the free games are only playable as a different selectable game than the game that the free games are awarded in. In yet another embodiment, the free game might comprise the play of a game which is not one of the games that is even selectable by the player The free games might be awarded based upon certain events occurring in or relative to the game which is being played, when external criteria are met, or a combination thereof.

In one embodiment, aspects of the invention comprise methods of game play and game presentation via a gaming machine. Such a gaming machine may have various configurations. The gaming machine may be located at a casino (and as such may be referred to as a "casino gaming machine"). As described below, the gaming machine may be part of a gaming system, such as a casino gaming system which links two or more of the gaming machines or one or more gaming machines with other devices, such as one or more table games, kiosks, accounting systems or servers, progressive systems or servers, player tracking systems or servers or the like.

Figure 1:
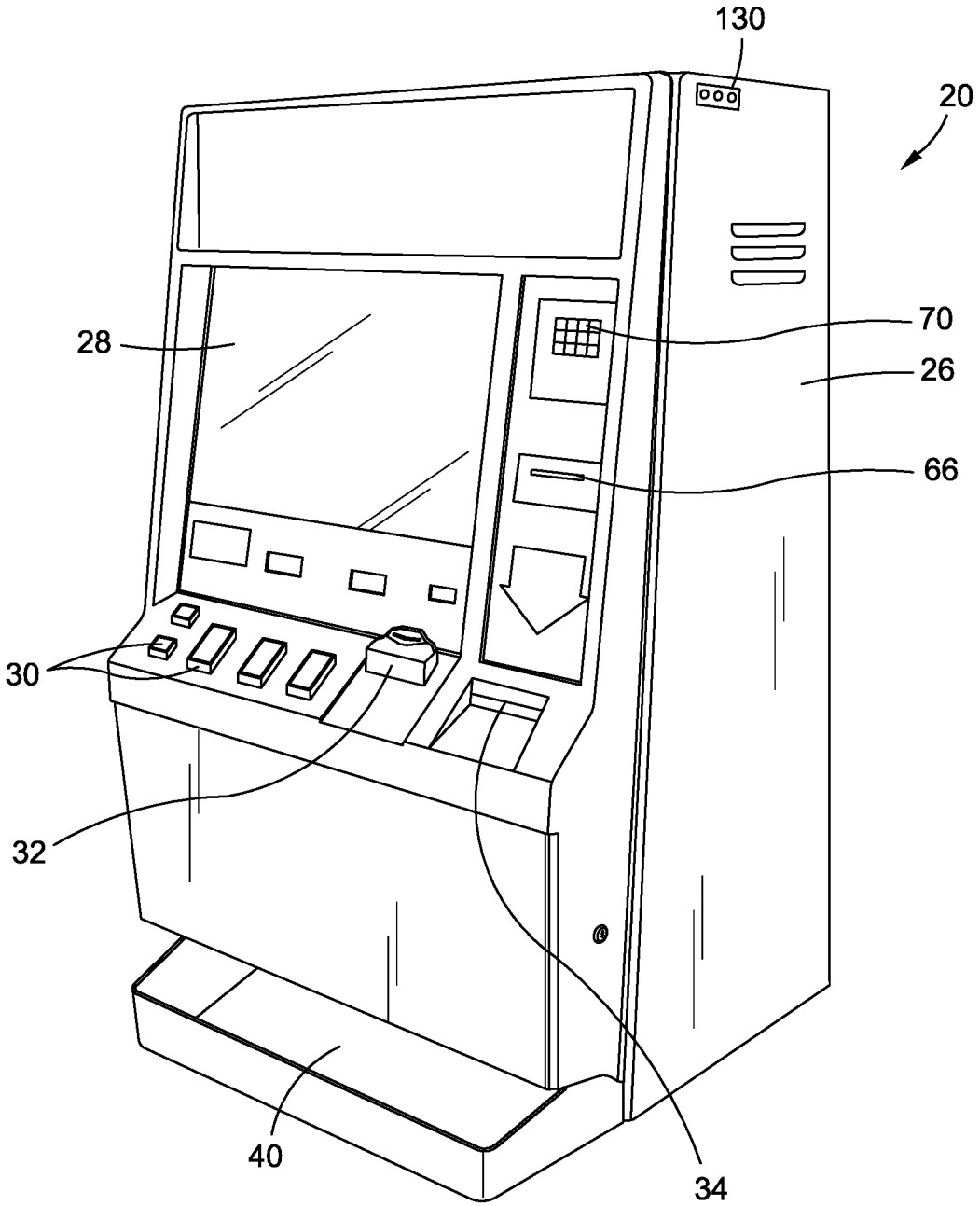
FIG. 1 illustrates a gaming machine in accordance with embodiments of the invention.

One configuration of a gaming machine 22 is illustrated in FIG. 1. As illustrated, the gaming machine 20 generally comprises a housing or cabinet 26 for supporting and/or enclosing various components required for operation of the gaming machine. In the embodiment illustrated, the housing 26 includes a door located at a front thereof, the door capable of being moved between an open position which allows access to the interior, and a closed position in which access to the interior is generally prevented. The configuration of the gaming machine 20 may vary. In the embodiment illustrated, the gaming machine 20 has an "upright" configuration. However, the gaming machine 20 could have other configurations, shapes or dimensions (such as being of a "slant"-type, "bar-top" or other configuration as is well known to those of skill in the art).

The gaming machine 20 preferably includes at least one display device 28 configured to display game information. The display device 28 may comprise an electronic video display such as a cathode ray tube (CRT), high resolution flat panel liquid crystal display (LCD), projection LCD, plasma display, field emission display, digital micro-mirror display (DMD), digital light processing display (DLP), LCD touchscreen, a light emitting display (LED) or other suitable displays now known or later developed, in a variety of resolutions, sizes and formats (e.g. 4:3, widescreen or the like). The display 28 may be capable of projecting or displaying a wide variety of information, including images, symbols and other indicia or information associated with game play, game promotion or other events. The gaming machine 20 might include more than one display device 28, such as two or more displays 28 which are associated with the housing 26. The gaming machine 20 might also include a top box or other portion. Such a top box might include one or more display devices 28, such as in addition to one or more main displays which are associated with the housing 26. Also, the gaming machine 20 might include side displays (such as mounted to the exterior of the housing 26) and might include multiple displays of differing sizes.

While the display devices may comprise one or more video displays, (such as for presenting video poker, video slots or other video-based games) in another embodiment, the gaming machine 20 may include one or more physical reels capable of displaying game information, such as slot symbols. In such a configuration, means are provided for rotating the physical reels. In one or more embodiments, the means may comprise a mechanical linkage associated with a spin arm, with movement of the spin arm (a "pull") by a user causing the reels to spin. In such an arrangement, the reels are generally allowed to free-wheel and then stop. In another embodiment, electronically controlled mechanisms are arranged to rotate and stop each reel. Such mechanisms are well known to those of skill in the art. In this arrangement, actuation of the spin arm or depression a spin button causes a controller (not shown) to signal the activation of the spin mechanism associated with one or more of the reels. Preferably, the controller is arranged to either turn off the signal to the device(s) effecting the rotation of each or all of the reels or generates a signal for activating a braking device, whereby the reels are stopped. The principal of such an arrangement is described in U.S. Pat. No. 4,448,419 to Telnaes, which is incorporated herein by reference.

In one embodiment, certain game outcomes (but preferably not all game outcomes) may be designated as winning outcomes (the non-winning outcomes may be referred to as losing outcomes). Prizes or awards may be provided for winning outcomes, such as monetary payments (or representations thereof, such as prize of credits), or promotional awards as detailed herein. As detailed below, the gaming machine 20 preferably includes a mechanism or means for returning unused monetary funds and/or dispensing winnings to a player.

The gaming machine 20 preferably includes one or more player input devices 30 (such as input buttons, plunger mechanisms, a touch-screen display, joystick, touch-pad or the like). These one or more devices 30 may be utilized by the player to facilitate game play, such as by providing input or instruction to the gaming machine 20. For example, such input devices 30 may be utilized by a player to place a wager, cause the gaming machine 20 to initiate one of the plurality of individually selectable games for play, to indicate cards to be held or discarded, to "cash out" of the gaming machine, or to provide various other inputs.

Figure 2:
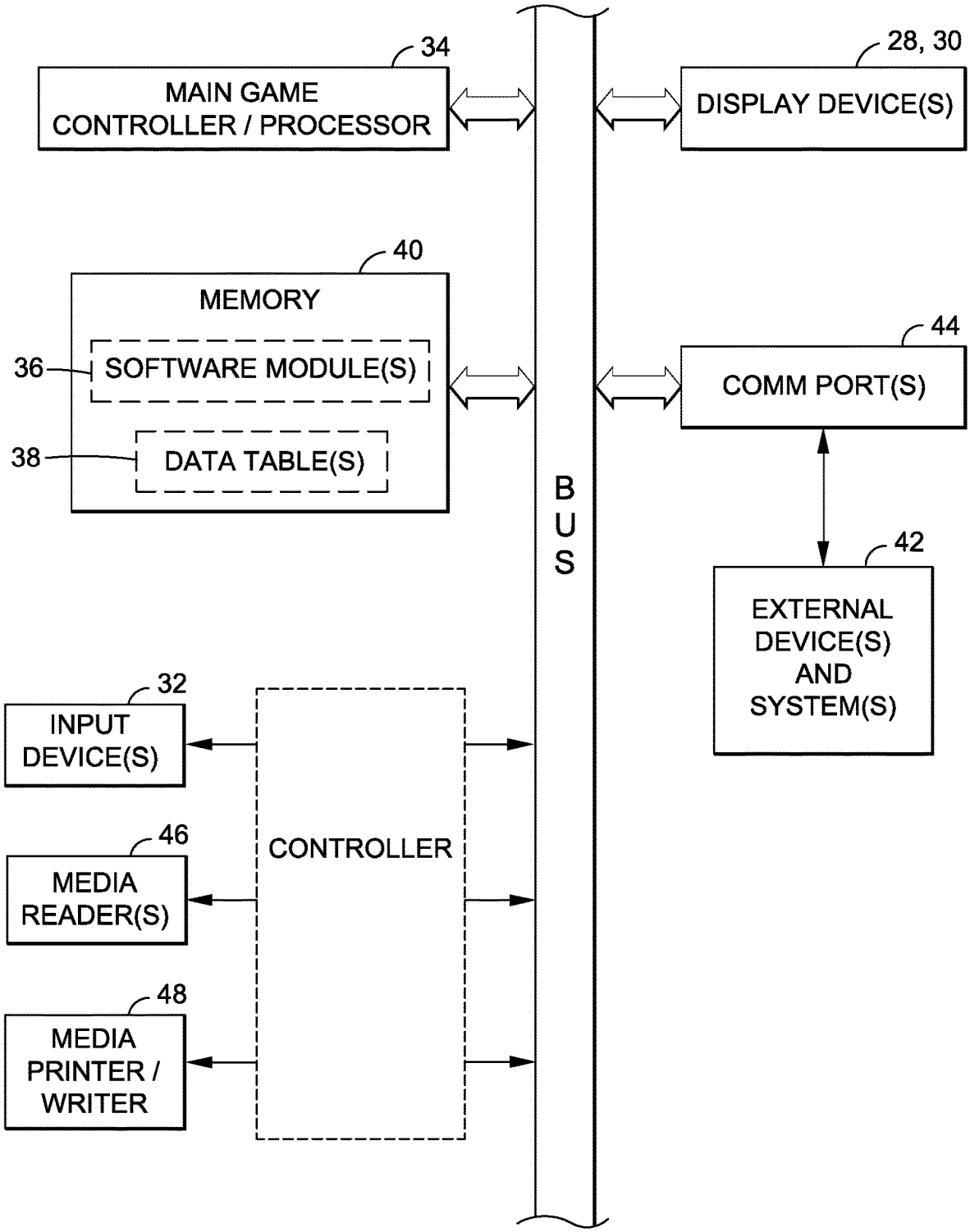
FIG. 2 illustrates elements of a gaming machine in accordance with embodiments of the invention.

Referring to FIG. 2, in one preferred embodiment, the gaming machine 20 includes at least one microprocessor or controller 34 for controlling the gaming machine, including receiving player input and sending output signals for controlling the various components or peripheral devices of the machine 20 (such as generating game information for display by the display devices 28, 30). The controller 34 may be arranged to receive information regarding funds provided by a player to the gaming machine 20, receive input such as a purchase/bet signal when a purchase/bet button is depressed, and receive other inputs from a player. The controller 34 may be arranged to generate information regarding a game, such as generating game information for display by the at least one display 28,30 for determining winning or losing game outcomes and for displaying information regarding awards for winning game outcomes, among other things.

The controller 34 may be configured to execute machine readable code or "software" or otherwise process information, such as obtained from a remote server. Software 36 or other instructions may be stored at a memory or data storage device 40, e.g. in a fixed or non-transitory configuration. The memory may also store other information or data, such as data stored in table or other forms (including, but not limited to look-up tables, pay tables and other information, including tracked game play information). The gaming machine 20 may also include one or more random number generators for generating random numbers (such as implemented by a random number generator software module stored in the memory 40 and executable by the processor or controller 34), such as for use in selecting slot symbols, cards or other game symbols, and for presenting the game in a random fashion (e.g. whereby the game is presented in a manner in which the player cannot control the outcome), pseudo-random fashion (e.g. such as where the game includes a skill component which can affect the outcome of the game), or in a manner in which the outcome is determined predominantly based upon the skill of the player.

Preferably, the controller 34 is configured to execute machine readable code or instructions (e.g. software) which are configured to implement the selected game. In this regard, the gaming machine is specially configured to present the game of the invention via specific software and/or hardware which causes the gaming machine to operate uniquely. For example, the controller 34 of the gaming machine 20 may be configured to detect a wager, such as a signal from a player's depressing of the "bet one" button (such as one of the buttons 32). Upon such an event and/or the player otherwise signaling the gaming machine 20 to present the game, the controller 34 may be configured to cause the at least one display 28, 30 to display information, such as a graphical interface or game display, including game symbols or other game information (such as graphically represented images of cards, slot symbols, dice, etc.). The controller 34 may accept input from a player of game inputs, such as a request to spin reels or the like, via the one or more player input devices of the gaming machine 20. As indicated above, the machine readable code may be configured in various manners, such as by having various "modules" of software which are designed to implement specific features of the game play or game presentation.

The gaming machine 20 may be configured to generate and present games in a stand-alone manner or it may be in communication with one or more external devices at one or more times. For example, the gaming machine 20 may be configured as a server based device and obtain game code or game outcome information from a remote game server (in which event the gaming machine controller may receive game information from the server, such as game outcome information, and use that server-generated information to present the game at the gaming machine). For example, the gaming machine 20 might be configured as a stand-alone device or as a server-based device for presenting games as Class III games (as defined by the U.S. Indian Gaming Regulatory Act) or as a server-based device for presenting games as Class II games (as defined by the U.S. Indian Gaming Regulatory Act).

As indicated, the gaming machine 20 is configured to present a plurality of wagering games. The games may be individually selectable for play (e.g. the gaming machine might offer the player the opportunity to play Game A, Game B or Game C, at the player's election). The gaming machines 20 are preferably configured to accept value, such as in the form of coins, tokens, paper currency, gaming tickets or other elements or devices representing value such as monetary funds. Thus, as indicated above, the gaming machine 20 preferably includes a mechanism or means for accepting monetary value. For example, as illustrated in FIG. 1, the gaming machine 20 might include a coin acceptor 32 for accepting coins. Of course, associated coin reading/verifying devices and coin storage devices may be associated with the gaming machine 20 if it is configured to accept coins. Likewise, the gaming machine 20 might include a media reader 34. Such a reader may be configured to accept and read/verify paper currency and/or other media such as tickets. Of course, in such event the gaming machine 20 may further be configured with one or more paper currency or ticket storage devices, such as cash boxes, and other paper currency or media handling devices (including transport devices).

The gaming machine 20 might also be configured to read FOBs, magnetic stripe cards or other media having data associated therewith and via which value or funds may be associated with the gaming machine 20. The mechanism for accepting monetary value might also comprise hardware and/or software which allows a player to transfer (such as electronically) funds from an account, such as a casino wagering account, or a bank or other financial institution account. Such a mechanism might include a communication interface which permits the gaming machine to communicate with a mobile phone, PDA, tablet or other electronic device of the player (such as via a physical interface or wired or wireless communications links, such as to enable the transfer of funds from the player to the gaming machine or system).

When the player associates funds with the gaming machine or an associated system, a credit balance is generated. The credit balance may comprise a plurality of monetary value credits. The player may wager some or all of the associated monetary value, such as by wagering one or more of the credits associated with the credit balance. For example, the player might provide input to a wager button or touch screen interface to wager a certain number of credits (such as "Bet 1 Credit", "Bet 5 Credits", "Bet Maximum Credits" or other options). In one embodiment, when the player's wager is received, the player's credit balance is reduced by the number of wagered credits. The player might then provide a separate input to begin the game. In other embodiment, the player might select a "play game" input, such as by pressing a "spin" button, which input is taken to comprise both an instruction to place a wager (such as of a pre-set or pre-selected number of credits) and to start the game. Of course, other configurations may be implemented for accepting monetary value from the player and for allowing the player to place a wager from the associated monetary value.

In one embodiment, the gaming machine 20 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. These winnings may be associated with the player's credit balance, thus increasing the player's credit balance.

In one embodiment, the player may provide an input to the gaming machine 20 to indicate their desire to cash out, such as by selecting a "cash out" button (such as implemented via one of the buttons 32) or touch screen feature or providing other input. In response, a monetary value represented by the player's credit balance or the like is preferably paid, transferred or otherwise provided to the player. For example, upon an award or at cash-out, associated funds may be paid to the player by the gaming machine 20 dispensing coins to a coin tray. In another embodiment, funds may be issued by dispensing paper currency or other media. In yet another embodiment, a player may be issued a media, such as a printed ticket, which ticket represents the value which was paid or cashed out of the machine. The aspects of gaming machine "ticketing" systems are well known. One such system is described in U.S. Pat. No. 6,048,269 to Burns, which is incorporated herein in its entirety by reference. In yet another embodiment, the cash-out might result in the dispensing of a card or other media which stores or represents the cashed-out funds, such as by writing funds information to a magnetic stripe of a card which is inserted into a media writer of the gaming machine or dispensed from the machine. In other embodiments, the cash-out mechanism may result in the funds value being transferred to an external device or account, such as a player's casino account (such as associated with a casino server), a remote bank or other financial account, or an electronic device such as a player's phone, PDA or tablet.

The gaming machine 20 may also include a player tracking device, such as a card reader 66 and associated keypad 70. Such player tracking devices are well known and may permit the game operator to track play of players of the gaming machine. The tracked play may be utilized to offer player bonuses or awards.

A casino may have numerous such gaming machines 20, such as located on a casino floor or in other locations. Of course, such gaming machines 20 might be used in other environments, such as an airport, a bar or tavern or other locations.

It will be appreciated that the gaming machine illustrated in FIG. 1 is only exemplary of one embodiment of a gaming machine. For example, it is possible for the gaming machine to have various other configurations, including different shapes and styles and having different components than as just described.

For example, instead of comprising a "casino"-style gaming machine, it is possible for the game of the invention to be presented on a computing device, including at a home or office computer or a player's mobile electronic device such as a PDA, phone or the like. In one embodiment, a player might log in to a casino server and the controller of the casino server may cause game information to be delivered to the player's computer via a communication link and then be displayed on a display of the player's computer. The communication link might comprise or include the Internet, a casino network such as a wired or wireless LAN, or combinations of public and/or private networks including wired and/or wireless links. In such a configuration it will be noted that the term "controller" may comprise more than one device. For example, in a server-based environment as described below, a controller at a server may generate game information and transmit that information to a local controller at a gaming machine or a player's computer or other electronic device. The local controller at the gaming machine or the player's computer or other electronic device may then cause game information to be displayed on one or more associated displays.

The gaming machine 20 may, as noted above, be part of a system which includes other devices. For example, the gaming machine 20 may communicate with one or more casino systems, such as a player tracking server or system, an accounting system or server, a ticketing system, a bonusing system, a tournament system, other gaming machines, and external devices.

Figure 3:
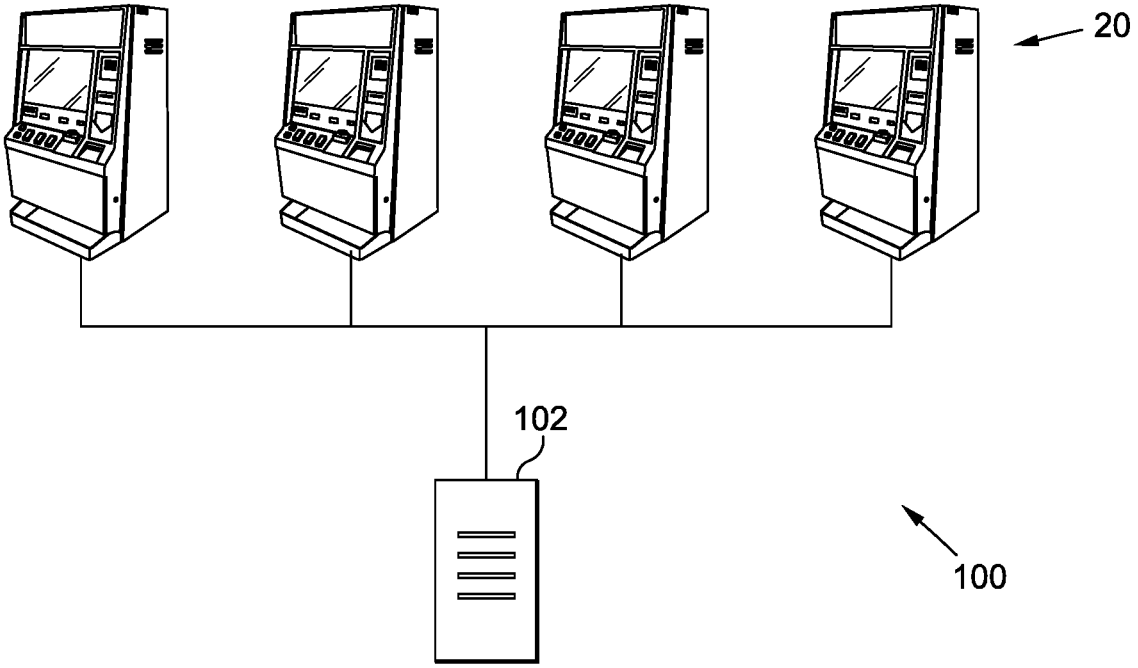
FIG. 3 illustrates a gaming system in accordance with embodiments of the invention.

Referring to FIG. 3, in one embodiment, a gaming system 100 includes at least two gaming machines 20. The gaming machines 20 are each configured to offer at least one wagering game, and may preferably present a plurality of (at least two) different wagering games, where each of the games may be selectable by a player when a player first starts play at the gaming machine (such that those games may be referred to as base games or selectable games). The base or selectable games are differentiated from feature or bonus games, which feature or bonus games are games awarded to a player when meeting certain criteria in the base or selectable games. Typically, the bonus or feature games do not require a separate wager by the player and they are part of the same game (e.g. part of the same game mechanic and math/paytable for the game).

In one embodiment, each gaming machine 20 may be configured to independently present games, while in other embodiments the operation of each gaming machine 20 is controlled in whole or in part from a remote location, such as a remote server 102. For example, game data may be generated remotely and be transmitted to the gaming machine 20 for display. The game data may then be downloaded to the gaming machine 20 via a wired or wireless communication link.

In such server-based configuration, when a player wishes to play a game at a gaming machine, the player selects one of the offered games, and the gaming machine sends a signal to the server 102. In the case of a single-player game, the server 102 may then generate game information and send it to the gaming machine 20 for display or generate a game outcome or the like which is transmitted to the gaming machine 20 and which the gaming machine uses to display the game and/or its outcome. In the case of a multi-player game, such as bingo, if there are least two such signals indicating at least two players desire to play, then the server 102 may be configured to initiate the presentation of the game. Such a configuration of a distributed gaming system are well known.

Figure 6:
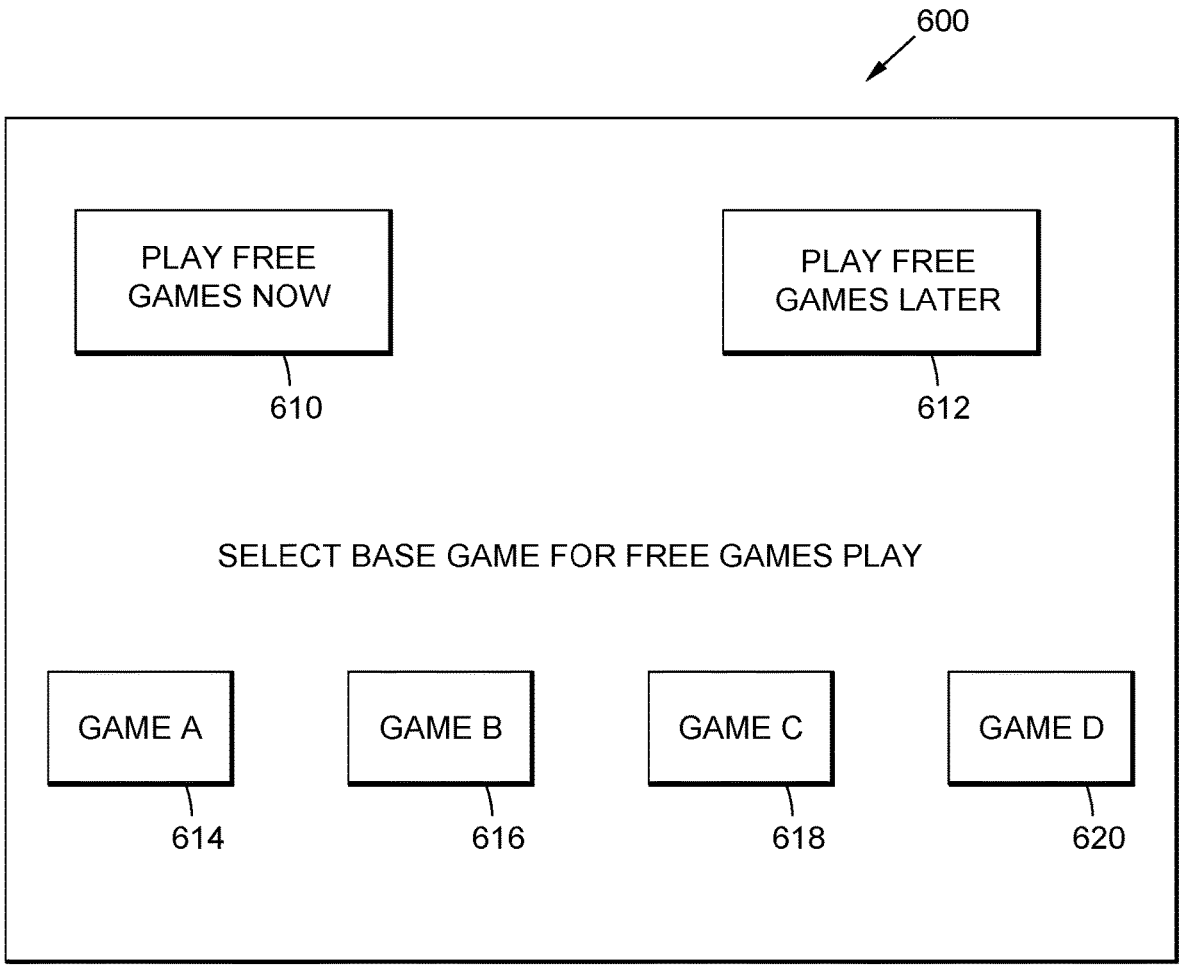
FIG. 6 illustrates a display screen of a gaming machine in accordance with embodiments of the invention.

In one embodiment of the invention, the display 28 of the gaming machine 20 may be configured to display a plurality of selectable games. A player may select one of the games for play using the input device 30. For example, the processor 34 of the gaming machine 22 may cause the display 28 to display a plurality of selectable games such as one or more video slots type game, one or more bingo games, video poker games, keno games, blackjack games, or other games now known or later developed. For example, as illustrated in FIG. 6 and described in more detail below, a menu of games might be displayed to a player and the player might select a game to play from that menu. As one example, the menu of games might comprise the display of a plurality of game icons.

After selection of one of the games, the processor 34 will cause the video display 28 to display the selected game for game play, where the player will select a wager amount and play the selected game. On each play of the selected game, an outcome of the game is determined, such as via the processor 34 (or a remote game server). As indicated above, outcomes of the game may be pre-designated as winning or losing outcomes. The player typically loses their wager if the outcome of the game is a losing outcome and may be awarded winnings, such as credits or currency, for a winning game outcome.

In accordance with the present invention, one or more free games may be awarded to the player relative to the play of a game. As described in more detail below, such free games preferably comprise the free play (e.g. free to the player—or in other words, without requiring a wager by the player) of a wagering game which comprise a different game instance than the game that the player is playing, wherein the outcome of each free game is thus determined independently of the outcome of the game that the player is playing.

In one embodiment and as described in more detail below, one or more free games might be awarded to a player based upon events occurring in the game that the player is playing (which may be referred to as "internal" events). As non-limiting examples, one or more free games might be awarded to the player if they receive certain game outcomes, certain game elements in the game or the like (such as certain bingo game patterns, certain slot game outcomes, the receipt of one or more symbols or symbol combinations, certain poker hands or cards, or the like—e.g. events which flow from the presentation of the game). In another embodiment and as also described in more detail below, one or more free games might be awarded to a player based upon events or criteria which are external to the game information and/or outcome (which may be referred to as "external" events or criteria), or events or criteria which comprise a combination of "internal" and "external" events. As non-limiting examples, one or more free games might be awarded when a player's aggregated wager amount reaches a predetermined threshold, when the player has lost a certain number of games, etc.

In accordance with an embodiment of the invention, awarded free games comprise free plays (e.g. without requiring the player to place a wager) of one or more instances of games other than the game instance that the player is playing. The free games may be independently playable by the player as wagering games, such as by being one of the games that the player may select to play as a wagering game at the gaming machine, or they might comprise plays of games that are not even selectable by the player. In this configuration, the player has the opportunity for the free game to result in a winning or losing game just as if they had played that game as a wagering game (e.g. the play of the different wagering game has designated winning and losing outcomes, where winning outcomes may have associated awards and free play of that game has the same designated winning and losing outcomes and awards). Of course, if the player obtains a winning outcome as a result of the free game play of the game, then the player may be awarded an award, such as credits that may increase the player's credit balance, or other types of awards, such as awards of other free games.

In accordance with one embodiment, this may be implemented in several ways. For example, the gaming machine 20 or game server 102 may select one of the other selectable games which may be played using the free game awards or otherwise comprising the free game awards. For example, the gaming machine or game server may make a random selection among the other selectable games, or may use certain criteria to select which selectable game in which to award the free games. Any criteria could be used to select which game to use for awarding the free games. For example, when the player's play has been tracked (such as through the use of a player's card or account), the gaming machine may select a game for which the player's account has no record of the player previously playing. This may have the benefit of introducing the player to new games, which may have the effect of the player playing the gaming machine more frequently.

Alternatively, the gaming machine may select a game for awarding the free games different from but related to the game the player was playing. For example, if the player is playing a video poker game when the free games are awarded, the gaming machine or game server may select a different video poker game in which to award the free games.

Figure 7:
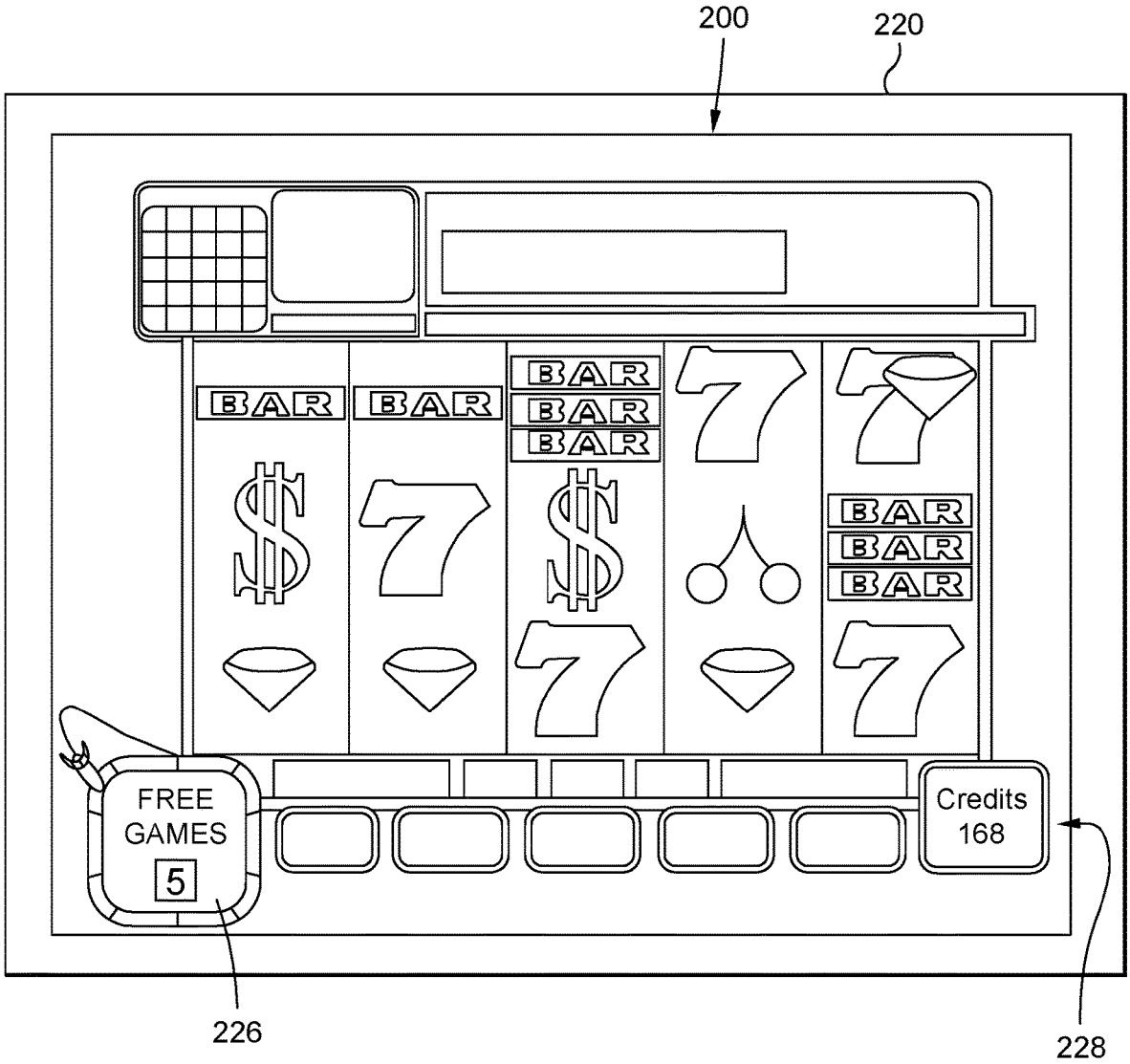
FIG. 7 illustrates a free game counter for use in displaying a number of free games awarded to a player.

Alternatively, the gaming machine may allow the player to select one of the games in which to award the free games from among all, or some subset thereof, of the games other than the game in which the free games are awarded. For example, the display 28 of the gaming machine 20 could display that the player won a certain number of free games or spins, and present the player with a selectable list of games from which the player may choose to play the free games. For example, as illustrated in FIG. 7, a bonus or free spins counter 226 may show the number of free games awarded to the player.

As illustrated in FIG. 6, when awarding free games, the gaming machine 20 may present the player with a choice of base games in which to play the free games, other than the game in which the free games were awarded. In the example which is illustrated in FIG. 6, the player has been presented with screen 600 (e.g. graphical display or interface) with the choices of any of Game A (614), Game B (616), Game C (618) or Game D (620) to select for play of the free games.

Additionally, the free games may be automatically presented immediately, or the gaming machine (or server) may allow the player to play the free games after they are awarded or delay the free games to be played at a later time. As one example, a player might be playing a game and one or more free games may be awarded. In one embodiment, the existing game play could be paused automatically and the one or more free games might be presented to the player immediately (and "in" the presentation of the existing game). For example, a player might be playing Game 1 and during that game, a free play of Game 2 may be awarded. Game 1 might be paused and a window might be opened or displayed over all or a portion of the window which is displaying Game 1, and in that window a free play of Game 2 might be presented. Once the free play of Game 2 is complete, that window or animation or the like might close and the remainder of Game 1 might be presented.

In another embodiment, when the free games are awarded, the gaming machine could present a screen which presents the player with the option 610 of playing the free games now, or the option 612 of delaying playing of the free games until a later time. If the player elects to play the free games immediately, the existing game might be paused and the free games might immediately be played by the player (before returning back to the original game). For example, during a particular game, a player might be awarded a free game. The player might be presented with the option to "Play free game now", which if elected by the player, might take the player to the game menu where they could then select the game that they would like to play as a free game. That free game would then be presented.

If the player delays playing the free games until a later time, the player may be awarded more free games before the player has played the earlier awarded free games. In this case, as noted above, the gaming machine may keep a running tally of the number of the awarded and unplayed free games and allow the player to play some or all of the number of free games at one or more later times.

Additionally, while the awarded free games might be playable on the same gaming machine as the player is currently playing (at which the free games were awarded), the free games may only be playable on a different gaming machine than the one where the free games were awarded. When the free games are only playable on a different gaming machine than the gaming machine where the free games were awarded, the gaming machine may print a ticket that the player can take to the other gaming machine to play the free games, for example. Alternatively, the free game awards may be stored in the system in association with the players account. In this configuration, the player might enter player account information or other identifying information at the gaming machine designated for the play of the free games, which would activate the free games for play on that gaming machine.

Figure 4:
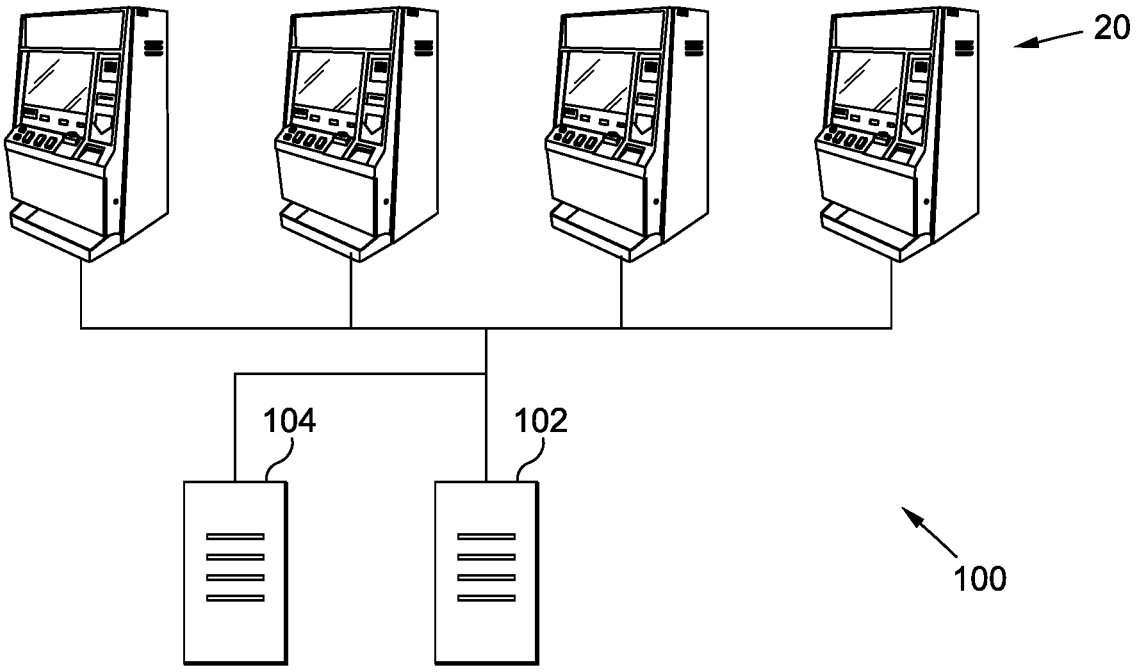
FIG. 4 illustrates a gaming system in accordance with embodiments of the invention.

Referring to FIG. 4, in one embodiment, the gaming system 100 includes at least two gaming machines 20, a remote server 102 and a free game server 104. The free game server 104 may award free games to a player playing on one of the gaming machines 20 instead of, or in addition to any free games awarded by the gaming machine 20 or the server 102. The free games awarded by the free game server 104 may be based on certain criteria occurring during the player's play of the game on the gaming machine such as described herein, or the free games awarded by the free game server 104 may be based on external criteria other than criteria occurring during play of the game at the gaming machine 20, or combinations thereof. In other embodiments, the free games awarded based on the external criteria other than criteria occurring during play of the game at the gaming machine could be awarded by the server 102 or by the game machine 20.

When the free game server 104 (or the game machine 20 or the server 102) awards free games based on "external" events or criteria (e.g. other than information or events tied solely to the game being played), the external criteria could be any external criteria, such as criteria based on player tracking. The player tracking may be based on tracking of a current session of play or based on player tracking over a time period.

When the criteria is based on player tracking, the player could have a player account, such as utilized with a player card insertable into the gaming machine 20. The free game server 104 could then track play of the player, and award free games when certain criteria are met as indicated by the tracked play. The tracked play could be based on play during one game play session, during multiple game play sessions, during game play sessions on one or more gaming machines, and even game play at different gaming machines at different locations, such as at different casinos.

For example, the free game server 104 could award one or more free games when the tracked play indicates the player has lost a certain amount during a current session, during a current time period, or over an extended period of time, such as over a week, a month or a year. The free game server 104 could award one or more free games when the tracked play indicates the player has lost a certain number of hands or spins in a row. Any other criteria could be used to award free games. For example, many player tracking systems have a plurality of levels that a player can reach based upon a volume and/or value of play, or a number of points earned over predefined time periods. The free game server 104 could award free games when the player achieves a new level within the player tracking system.

Free games might be awarded based upon tracked play by more than one player. For example, the play of multiple players might be tracked and when criteria are met for an award of a free game based upon the aggregated or collective activities of those players, a free game may be awarded.

Free games might be awarded even when a player's identity is not known or player-specific actions are not tracked. For example, the free game server 104 could also award free games randomly, or based on promotions being offered. As one example, a free game might be awarded anytime a player wagers a wager having a certain threshold value. As another example, a free game might be awarded at a certain time, or after a certain number of games are played at the gaming machine during a particular period of time (whether played by one player or more than one player at the machine). As yet another example, even though the identities of one or more players may not be known, a free game might be awarded when wagering at one or more gaming machines reaches a threshold value.

Any of the herein described ways of awarding free games could be awarded by the gaming machine 20, by the server 102 and/or by the free game server 104. Moreover, free games could be awarded during a session by more than one of the gaming machine 20, by the server 102 and/or by the free game server 104. For example, the gaming machine may be configured to award free games when certain criteria are met during play of the base game, while at the same time the server 102 or the free game server 104 may award free games based on other criteria, such as player tracking as discussed herein.

In accordance with the invention, each presentation of a free game preferably comprises presentation of a wager-based game without the player being required to place a wager to play the game, but with the player still eligible to win an award for a winning game outcome.

The outcome of the free game is determined independently of the outcome of the game that the player is playing (e.g. separate from the game mechanic and math/pay table of the game that the player is playing). For example, assume that a player is playing game A. The outcome of game A may be determined by an RNG and/or player input, based upon assigned game indicia and selected indicia (such as in keno and bingo), etc. Preferably, the outcome of the free game (which preferably comprises a free play of a different game, such as game B) is determined independently of game A, such as based upon a different RNG outcome, different player input, different assigned game indicia and selected indicia, or the like. In this configuration, the free game is not part of the game that is currently being played by the player (e.g. is not triggered by or part of the game mechanic and pay table for that game), but is instead an instance of an entirely different game.

As indicated, aspects of the invention may be applied to different types of games, such as Class II or Class III games. The present invention has particular applicability to Class II games such as the game of bingo. In accordance with such a game, a bingo session may be started with the call of a number of bingo balls (or other indicia) for matching to one or more player indicia, such as associated with a game card. As is known, the game numbers may be selected in a variety of fashions. Of course, in a traditional manner, the numbers may be printed on balls, and the balls may be randomly drawn. In an electronic game environment such as that illustrated in FIG. 2, the numbers may be selected with a random number generator of the server 102.

In one embodiment, the game card is a bingo card such as illustrated in FIG. 3 having spaces bearing symbols such as numbers. In a gaming environment where the game is presented on an electronic gaming machine such as that described above, the game card is preferably electronically displayed (wherein the game card is not limited to a 5×5 grid but might comprise other numbers of spaces/symbols)

Different bingo games may be played as part of the bingo game session (which session may only end when a game ending bingo pattern is received in one of the games). For example, relative to the particular bingo session, players might elect to play Bingo Game A or Bingo Game B. Bingo Game A may use a first set of bingo cards and have a first pay table of winning patterns and awards. This game might have a $1 wager and an average payback of 93%. Bingo Game B may use a second set of bingo cards and have a second pay table of winning patterns and awards. This game might have a $1 wager and an average payback of 95%.

One player, Player A, may elect to play Game B by placing a $1 wager. The outcome of that game is determined by comparing the called bingo balls or numbers to the numbers on a game card which is assigned to Player A from the set of game cards for Game B. As noted, one or more patterns of matching numbers or symbols are designated as winning combinations (where such a winning combination preferably has a prize or award associated therewith, whereby the combination may be referred to as a "prize winning" combination). For example, a prize winning patterns may be one or more of those illustrated in FIG. 5, such as "four corners," "cover-all," "a diagonal" or others.

In one embodiment of the game, a player is required to daub matching numbers. This may be performed manually, such as by a player touching an area of a display corresponding to the card location of a number match, or by the player instructing the gaming machine to daub all matches (such as by selection of a "daub" button) on the machine. In one embodiment, the step of daubing results in a confirmation of a match and may include the display of the match on the player's game card.

The outcome or results of the game as to the player may be displayed or represented in various manners, including as one or more secondary events, displays or graphics. For example, instead of displaying the result of the bingo game as a daubed bingo card, the result might instead or additionally be displayed as a secondary event which simulates or comprises another gaming type event, such as the spinning of a roulette wheel, a blackjack game, a video poker game, a slot-type graphic, a craps or other dice event, a simulated horse or dog race, or other types of gaming events now known or later developed. In one embodiment, each player's game outcome is represented as such as event, whether the outcome is a winning or losing outcome. In another embodiment, only winning outcomes might be displayed as such an event.

In accordance with the present invention, such a game system may be modified so that one or more events in the bingo game (such as particular designated matching patterns) result in an award of one or more free games to the player. Alternatively, the game system may be modified so that one or more external events result in the award of one or more free games to the player.

Thus, in the example above, Player A might be awarded a free play of Game A. As a result, without any additional wager, a game card from the set of game cards for Game A may be assigned to Player A. The outcome of the free play of Game A is then determined by comparing the called bingo balls for the game session to the game card for Game A which was awarded to Player A. Matches of called indicia to indicia associated with the card are determined and the outcome of the game is evaluated based upon the pay table for Game A.

Of course, in the example noted above, the game system might generate different bingo game sessions and the free game which is award to the player might comprise the play of a game in an entirely different bingo game session than the bingo game session that their currently played bingo game is tied to.

As noted, the present invention may be applied to various types of games, such as Class II and Class III games. For example, a player might play a game of video poker and might be awarded a free play of a slot game. In another embodiment, a player of a game of bingo might be awarded a free play of a skill-based game.

In one embodiment, free games may be awarded as direct awards. In other embodiments, a player may be awarded "partial" awards which can be aggregated into a full free game play award. For example, a player might be awarded 50% of a free game at one time and then another 50% of a free game at another time, at which point the player has a free game to play.

The present invention has numerous advantage over the prior art. As noted above, in the prior art, wagering games exist where one of the outcomes of the game may comprise additional actions in the game, such as the presentation of one or more bonus events (such as in a slot game, the display of certain symbols might cause a player to be presented by a different graphical user interface from which they may select one or more icons wherein each icon is associated with a potential bonus award). In these games, the additional events are part of the logic of the wagering game, including the overall pay structure for the game, and are presented as part of the existing game. In addition, some existing wagering games offer the player the opportunity for free game play of that same game. For example, during the play of a slot-type game, a player might obtain an outcome which entitles the player to one or more additional free spins (e.g. without additional wager) of the reels and wherein each additional spin of the reels may result in a winning outcome having an associate award. Importantly, these free games offer the player the opportunity for an award which is truly separate from the game they are playing. For example, if a player is playing a slot game with a 96% average payback, each play of that slot game is determined relative to the game mechanic and pay table for the game that results in this average payback. In accordance with the invention, the free game that the player plays is independent of the game mechanic and paytable of that slot game. Thus, even if the player is awarded a free play of the same slot game, the outcome of that game is not determined by or within the original slot game they were playing and the associated pay table.

A benefit of the present invention is that a player may be awarded free games of game instances other than the game instance the player is currently engaged in, where the free game is not part of the game the player is playing and is itself a completely different game instance. As one example, a game manufacturer may add a new game C to a gaming machine that already offers games A and B to the player. In order to expose new game C to the player, the player might be awarded one or more free game plays of game C as a result of the player's play of games A or B. As another example, a first gaming machine may offer game A. A casino might place new gaming machines on the casino floor where those new gaming machines present game B. The casino may desire to award free games of game B at the gaming machine which offers game A so as to cause players to locate the new gaming machines which offer game B and expose the players to that new gaming machine and game. The present invention may similarly be used to award free game play of games which are underperforming or under played.

The invention may also allow a player to win free games that they have selected. For example, a player might have favorite games A and B. While playing game A, the player might win free games and elect to have those be free plays of game B, which is their second favorite game.

As another example, an operator might wish to use the free games as an award to one or more players, such as to incentivize game play. Advantageously, the game operator can control which games are awarded as free games. For example, players might play wagering games having an average payback of 95%. Instead of awarding free game plays of those games, the operator might award free plays of a game which may not even be selectable by the players, but which (if played based upon placement of a wager by the player instead of as a free game without requirement of a wager by the player) only has an average payout of 85%. In this manner, the operator can still award free game play, but the average outlay by the operator is reduced.

In the configuration of the present invention, game mechanics and game pay tables are not changed to accommodate the award of free games. Instead, the free games simply comprise another play of a game having a set mechanic and paytable, simply without the requirement that the player place a wager. Thus, the play of the game, including the odds of a winning result, are the same for a play of the game for free as if the player had placed a wager to play the same game.

Of course, each time a player plays a free game, they have a chance for a winning outcome and thus an associated award. Thus, the free games (or at least the winnings therefrom) must be funded given that the players are not placing wagers to play those games. In one embodiment, a casino or other third party entity may fund the free games. For example, as noted above, a casino might utilize promotional funds to fund the games which are awarded to the players for free play.

Another advantage of the invention is that a player may be permitted to "bank" free games. In the prior art where free spins or the like are awarded as part of the existing game, those events must be presented during that game because they are part of that game. On the other hand, because the free games which are awarded in accordance with the invention are plays of entirely different games from the game that the player is playing, those free game awards can be stored and/or played at a completely different time.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A gaming machine comprising:

a monetary funds accepting mechanism for accepting monetary funds from a player in creating a player credit balance;

at least one display device;

at least one player input device;

a memory device;

a controller; and machine-readable code stored in said memory device executable by said controller to, in response to a wager placed by said player from said player credit balance, cause said at least one display device to display information regarding a play of a first bingo game to the player, said first bingo game played with a first bingo card assigned to said player, said first bingo card selected from a first set of bingo cards for said first bingo game and played against bingo balls selected in said first bingo game and having a first set of winning patterns and associated awards;

machine-readable code executable by said controller to cause said controller to display information on said display device indicating an award of a free second bingo game to said player when predetermined criteria are met;

machine-readable code executable by said controller to cause said controller to cause said display device to display information regarding a play of the free second bingo game, said play of said free second bingo game played with a second bingo card assigned to said player, said second bingo card selected from a second set of bingo cards for said free second bingo game and played against bingo balls selected in said free second bingo game and having a second set of winning patterns and associated awards; and machine-readable code stored in said memory device executable by said controller to cause said display device to display choices for player selection to play the free second bingo game immediately or to play the free second bingo game at a later time, wherein if the player selects to play the free second bingo game later, the machine-readable code causes said display device to display information regarding a tally of a number of free second bingo games awarded and unplayed.

2. The gaming machine of claim 1, wherein the free second bingo game is awarded based on predetermined criteria occurring in play of the first bingo game.

3. The gaming machine of claim 1, wherein the free second bingo game is awarded based on predetermined criteria occurring other than criteria occurring in play of the first bingo game.

4. The gaming machine of claim 3, wherein the predetermined criteria occurring other than criteria occurring in play of the first game is a random selection to award the free second bingo game.

5. The gaming machine of claim 3, wherein the predetermined criteria occurring other than criteria occurring in play of the first game is criteria occurring in player tracking of the player.

6. The gaming machine of claim 1, wherein said first bingo game is selected by said player from a set of available bingo games and further comprising machine-readable code stored in said memory device executable by said controller to select as said second bingo game one of the games from said set of available bingo games other than the first bingo game.

7. The gaming machine of claim 1, wherein said play of said first bingo game comprises comparing a set of called game indicia to indicia associated with said first bingo card and to indicia associated with said second bingo card.

8. The gaming machine of claim 7, wherein a first set of called game indicia are compared to said indicia associated with said first bingo card and a second set of called game indicia are compared to said indicia associated with said second bingo card.

9. The gaming machine of claim 1, wherein the first bingo game has a first pay table of winning outcomes and associated awards and said second bingo game has a second pay table of winning outcomes and associated awards.

10. A game system comprising:

at least one game server comprising a processor configured to execute machine readable code stored in a memory, said machine readable code executable by said processor of said game server configured to cause said game server to:

implement a first bingo game, said first bingo game played with a first set of bingo cards, a first set of selected bingo balls, and a first paytable of winning game patterns and associated awards;

implement at least one second bingo game, said second bingo game played with a second set of bingo cards, a second set of selected bingo balls, a second paytable of winning game patterns and associated awards;

a plurality of gaming machines, each of said gaming machines, comprising:

a monetary funds accepting mechanism for accepting monetary funds in creating a player credit balance;

a display device;

a player input device;

a memory device;

a controller;

machine-readable code stored in said memory device and executable by said controller to, in response to a wager placed by said player from said player credit balance, cause said at least one display device to display a play of a first game to the player, said first bingo game played with a first bingo card assigned to said player, said first bingo card selected from a first set of bingo cards for said first bingo game and wherein a winning game outcome as to said first bingo card results in an award in accordance with said first paytable;

machine-readable code stored in said memory device and executable by said controller to cause said controller to display a graphic on said display device indicating an award of a free play of said second bingo game to said player when predetermined criteria are met; and machine-readable code stored in said memory device and executable by said controller to cause said controller to cause said display device to display said play of the free second bingo game, said play of said second bingo game played with a second bingo card assigned to said player, said second bingo card selected from a second set of bingo cards for said second bingo game and wherein a winning game outcome as to said second bingo card results in an award in accordance with said second paytable; and at least one communication interface which permits said at least one game server to transmit information regarding said first bingo game and said second bingo game to the gaming machines and to receive information from the gaming machines.

11. The system according to claim 10, further comprising a free game server connected to the at least one game server and to the communication interface, the free game server configured to send a signal to the gaming machine to award said second free bingo game based on predetermined criteria other than game play on the gaming machine.

12. The system according to claim 10, wherein the free second bingo game is awarded based on predetermined criteria occurring in play of the first bingo game.

13. The system according to claim 10, wherein the free second bingo game is awarded based on predetermined criteria occurring other than criteria occurring in play of the first bingo game.

14. The system of claim 13, wherein the predetermined criteria occurring other than criteria occurring in play of the first bingo game is criteria occurring in player tracking of the player.

15. The gaming system of claim 10, wherein said game session information comprises a set of called game indicia and said play of said first bingo game comprises comparing said set of called game indicia to indicia associated with said first bingo card and to indicia associated with said second bingo card.

16. The gaming system of claim 10, wherein said game session information comprises said first and second bingo cards.

17. The gaming system of claim 10, wherein said first and second sets of bingo cards are different.

18. The system of claim 10, wherein the first bingo game has a first pay table of winning outcomes and associated awards and said second bingo game has a second pay table of winning outcomes and associated awards.

* * * * *